US006758487B1

(12) United States Patent
Stucki

(10) Patent No.: US 6,758,487 B1
(45) Date of Patent: Jul. 6, 2004

(54) SAFETY EDGE FOR SKIS AND SNOWBOARDS AND METHODS FOR PRODUCING A SKI AND SNOWBOARD WITH SUCH A SAFETY EDGE

(76) Inventor: Walter Stucki, Schwarzwaldstrasse 7, CH-8902 Urdorf (CH)

( * ) Notice: Subject to any disclaimer, the term of this patent is extended or adjusted under 35 U.S.C. 154(b) by 0 days.

(21) Appl. No.: 09/623,631

(22) PCT Filed: Oct. 4, 1999

(86) PCT No.: PCT/CH99/00468

§ 371 (c)(1),
(2), (4) Date: Sep. 6, 2000

(87) PCT Pub. No.: WO00/40310

PCT Pub. Date: Jul. 13, 2000

(30) Foreign Application Priority Data

Jan. 7, 1999 (CH) ..... 16/99

(51) Int. Cl.[7] ..... A63C 5/048
(52) U.S. Cl. ..... 280/608; 280/609; 280/14.21
(58) Field of Search ..... 280/604, 608, 280/609, 11.18, 606, 14.2, 14.21, 14.22, 28, 600, 601, 610

(56) References Cited

U.S. PATENT DOCUMENTS

| | | | | | |
|---|---|---|---|---|---|
| 3,134,604 | A | * | 5/1964 | Aublinger | 280/608 |
| 4,377,297 | A | * | 3/1983 | Staufer | 280/609 |
| 4,509,771 | A | * | 4/1985 | Nussbaumer | 280/609 |
| 4,906,016 | A | * | 3/1990 | Varan | 280/608 |
| 4,953,884 | A | * | 9/1990 | Diard et al. | 280/609 |
| 4,971,350 | A | * | 11/1990 | Fagot | 280/609 |
| 5,158,318 | A | * | 10/1992 | Dittmar | 280/608 |
| 5,230,527 | A | * | 7/1993 | Varan | 280/609 |
| 5,249,819 | A | * | 10/1993 | Mayr | 280/602 |
| 5,451,276 | A | * | 9/1995 | Junius | 148/632 |
| 5,553,884 | A | * | 9/1996 | Abondance | 280/609 |
| 6,062,585 | A | * | 5/2000 | Hess | 280/608 |
| 6,131,939 | A | * | 10/2000 | Fels | 280/601 |

FOREIGN PATENT DOCUMENTS

| | | | |
|---|---|---|---|
| DE | 2061915 | * | 6/1972 |
| DE | 24 59 980 | | 12/1974 |
| DE | 2403944 | * | 8/1975 |
| EP | 0 622 097 A1 | | 3/1994 |
| FR | 1274895 | * | 9/1961 |
| FR | 2 539 042 | | 1/1983 |
| NO | 80786 | * | 9/1952 |
| WO | wo-9425124-a1 | * | 11/1994 |

OTHER PUBLICATIONS

WO 94/25124, Publication Date Nov. 10, 1994, Ski.

* cited by examiner

*Primary Examiner*—Brian L. Johnson
*Assistant Examiner*—Christopher Bottorff
(74) *Attorney, Agent, or Firm*—Rankin, Hill, Porter & Clark LLP

(57) ABSTRACT

A security edge for skis and snowboards (1) which comprises indentations or protrusions with variable thickness which are designed, depending on the type of ski or snowboard, to be variable in length, width and height and offer a permanent grip on surfaces such as snow, ice, artificial snow etc.

9 Claims, 3 Drawing Sheets

SAFETY EDGE FOR SKIS AND SNOWBOARDS AND METHODS FOR PRODUCING A SKI AND SNOWBOARD WITH SUCH A SAFETY EDGE

BACKGROUND OF THE INVENTION

The present invention relates to skis and snowboards with edges and it especially relates to security edges for skis.

To skiers or snowboarders, the occurrence of accidents such as involuntary slipping, falls, collisions, etc., is frequent. These accidents are often painful and can lead to hospitalization. One of the reasons for such accidents is the insufficient security of the skier or snowboarder, due to the fact that the edges of their skis or snowboards have insufficient grip on surfaces such as snow, ice, artificial snow etc.

In order to guarantee the grip of skis and snowboards on these surfaces, the skis and snowboards comprise special edges made of hard material such as steel. These edges must be ground regularly in order to guarantee a sufficient surface grip. It is a disadvantage that this kind of edge, depending on the kind of surface, often becomes blunt in a very short time and then no longer guarantees a sufficient grip. Thus, the grinding of the edges becomes necessary in order to guarantee the security of the skier or snowboarder respectively. This is especially acute with difficult surfaces such as ice.

SUMMARY OF THE INVENTION

An object of the present invention is the improvement of the security of skiers or snowboarders and the prevention of skiing and snowboarding accidents. The object is especially directed toward a security edge, which does not have the previously mentioned disadvantages. This security edge is to be producible from proven materials, it is to be easy to maintain and it is to be largely compatible with current standards of the ski and snowboard industry.

The invention is based on the realization that the form of the edges of skis and snowboards is decisive for the grip of the skier or snowboarder, respectively, on the surface. The invention shows security edges for skis and snowboards that comprise indentations and protrusions of variable depth. The indentations and protrusions are designed in a variable manner in length and depth depending on the type of ski or snowboard, and offer a permanent grip on surfaces such as snow, ice artificial snow, etc., even when the grinding of the edges has become blunt.

BRIEF DESCRIPTION OF THE DRAWINGS

The invention is further explained in connection with the following figures, whereby.

DETAILED DESCRIPTION OF THE PREFERRED EMBODIMENTS

Figure 1:
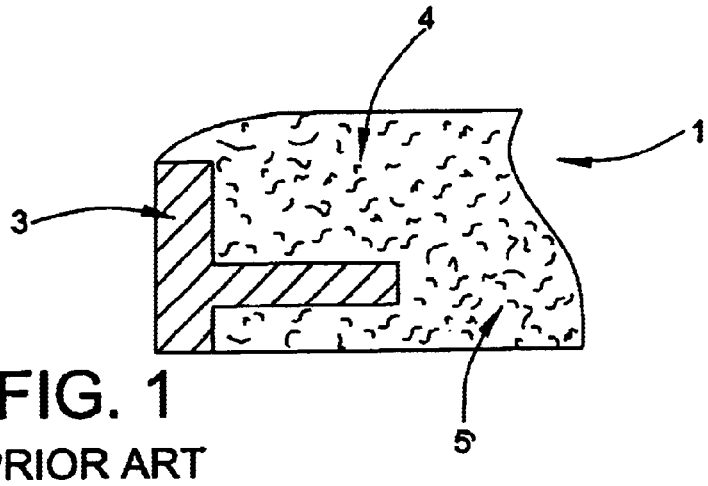
FIG. 1 PRIOR ART
FIG. 1 shows a cross section through a part of an edge for skis or snowboards according to the state of the art.

FIG. 1 shows a cross section through part of an edge for skis or snowboards according to the state of the art. The edges 3, made of a hard material such as steel, are attached to the lateral limitation of a ski or snowboard. With knowledge of the present invention other edge materials can also be used. These edges 3 are attached in-between the top covering surface 4 and the bottom surface 5 in the ski or snowboard. The edge 3, according to the state of the art, has a uniform width over the length of the ski or snowboard so as to define a generally planar side surface of the ski or snowboard.

Figure 2:
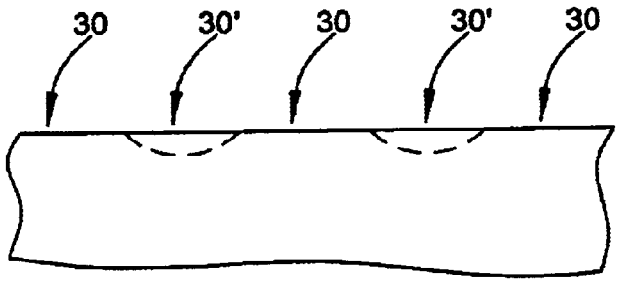
FIG. 2 shows a top view of part of a first exemplified embodiment of a ski or snowboard with indentations on the security edge.
Figure 3:
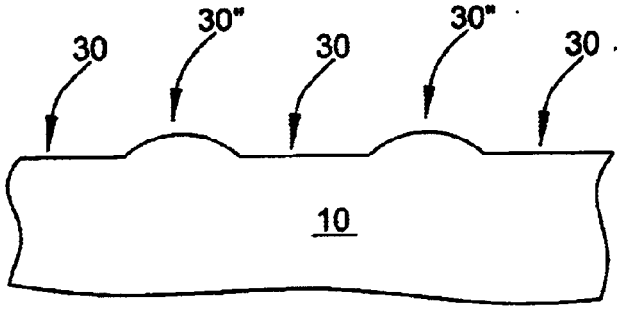
FIG. 3 shows a top view of a part of a second exemplified embodiment of a ski or snowboard with protrusions on the security edge.
Figure 4:
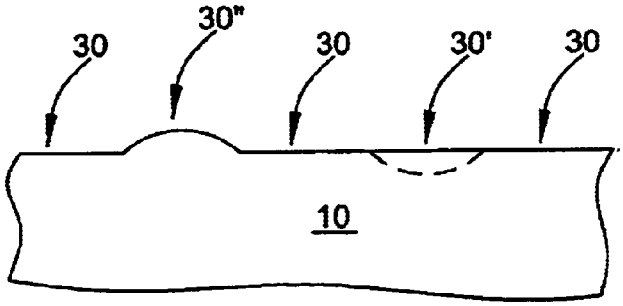
FIG. 4 shows a top view of a part of part of a further exemplified embodiment of a ski or snowboard with indentations and protrusions on the security edge.

FIGS. 2 to 4 show top views of parts of exemplified embodiments of a ski or snowboard 10. The ski or snowboard 10 has an edge 30, similar in cross section to that shown in FIG. 1, secured to the side or lateral limitation thereof. The edge 30 defines a planar side surface of the ski or snowboard, the plane defined by the edge 30 being generally parallel to a length direction of the ski or snowboard. However, the present invention, as shown in the drawings, includes security edges in the form of indentations or protrusions 30', 30" that have non-uniform widths so as to define a relatively irregular or non-planar side surface of the ski or snowboard.

As will be apparent from the following description, the side surface of the ski or snowboard of the present invention includes generally planar portions or edges 30, like those of the prior art, as well as non-planar portions or security edges 30', 30", which extend relatively to one side or the other (i.e., into or away from) of the plane defined by the planar portions (edge 30), thereby defining the indentations 30' and/or protrusions 30". Moreover, as will be set forth hereinafter, the security edges 30', 30" (indentations or protrusions) may be integrally formed with the planar edge 30 and applied or affixed to the ski or snowboard as a single continuous piece. Alternatively, the security edges 30', 30" and edge 30 may be formed as separate discrete sections and applied or affixed to the ski in a desired sequence or pattern. In any event, along the length of the ski or snowboard there is a sequence of planar edges 30 and non-planar security edge(s) 30', 30", as shown in the drawings.

Specifically, the first embodiment of a ski or snowboard according to FIG. 2 shows edges 30 and security edges in form of indentations 30'. The second embodiment of a ski or snowboard according to FIG. 3 shows edges 30 and security edges in form of protrusions 30". The further embodiment of a ski or snowboard according to FIG. 4 shows edges 30 and security edges in form of indentations 30' and protrusions 30". Accordingly, the side surfaces of the skis or snowboards 10 shown in FIGS. 2–4 have edges 30 defining planar portions and security edges 30', 30" defining non-planar portions, the non-planar portions being either convex (protrusions) or concave (indentations) when viewed from above. The specialist with knowledge of the present invention has further possibilities for the design of such edges and security edges of skis or snowboards at his or her disposal.

Figure 5:
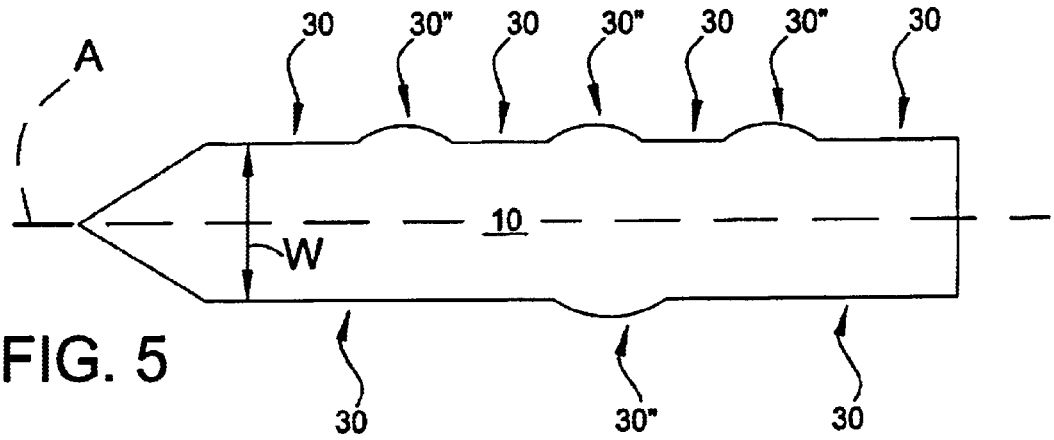
FIG. 5 shows a top view of a first exemplified embodiment of a ski with protrusions on the security edge.
Figure 6:
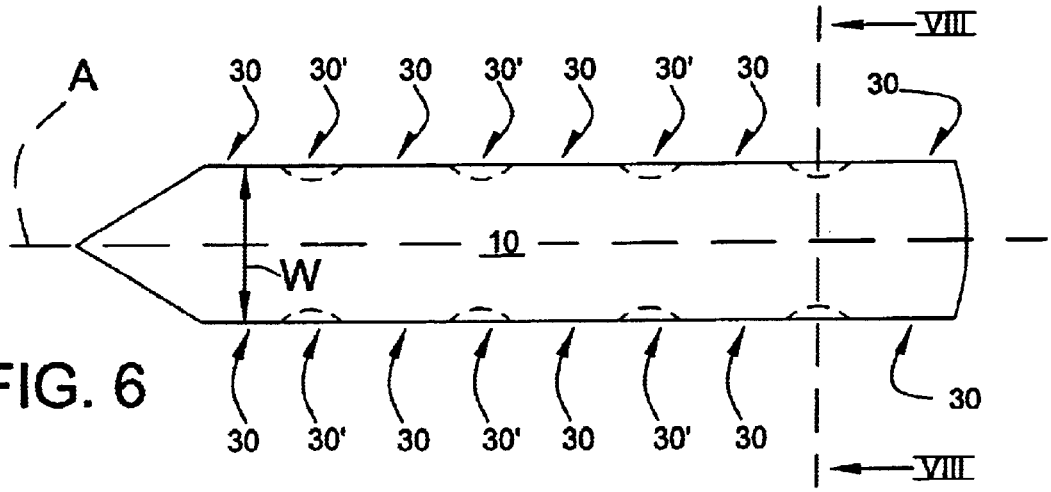
FIG. 6 shows a top view of a further exemplified embodiment of a ski with indentations on the security edge.
Figure 7:
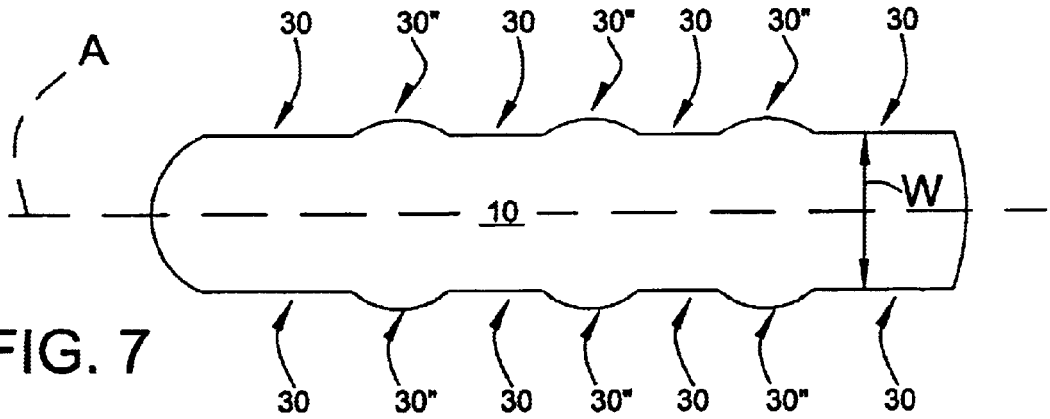
FIG. 7 shows a top view, of an exemplified embodiment of a snowboard with protrusions on the security edge.
Figure 8:
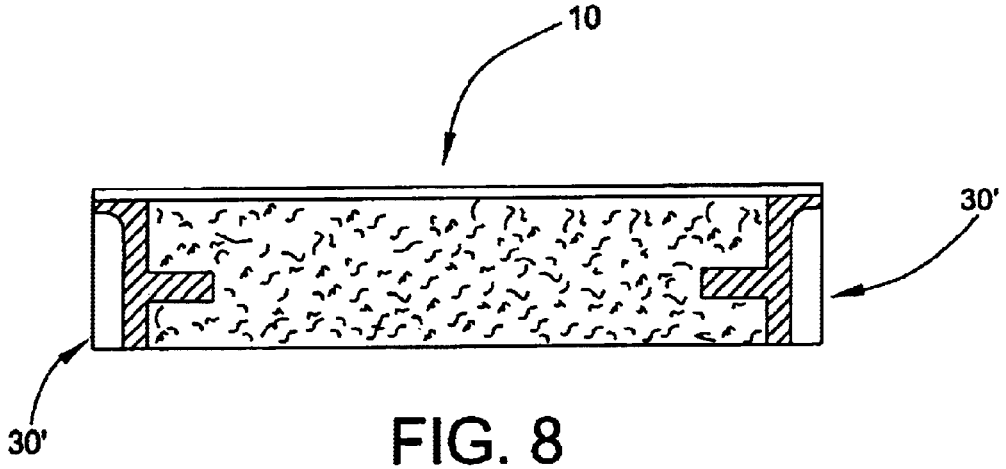
FIG. 8 is a cross sectional view as seen through line VIII—VIII of FIG. 6.

FIGS. 5 to 7 show top views of exemplified embodiments of skis or snowboards 10 including security edges 30', 30" in the form of indentations or protrusions formed on the lateral sides of the skis or snowboard, according to FIG. 2 and 3, respectively. The ski or snowboard 10 is shown to have a longitudinal axis A and a width dimension W in a direction essentially perpendicular to the longitudinal axis A. The indentations extend inwardly, in the width direction, toward the longitudinal axis while the protrusions extend outwardly, in the width direction, from the longitudinal axis. In other words, when viewed from above, the indentations are relatively concave and the protrusions are relatively convex.

The security edges, in form of indentations and protrusions 30', 30" of variable depth, can be formed of variable or non-uniform length and depth, according to the type of ski or snowboard. As is shown in FIGS. 2 to 7 at least one security edge 30', 30" is applied to skis or snowboards. It is, for example, possible to apply one single continuous security edge of variable width (i.e., non-planar) on each lateral side of the ski or snowboard or it is possible to apply several security edges 30', 30" separated by edges 30 of constant width on the lateral sides of the skis or snowboards.

It is not compelling to apply the security edges 30', 30" to the ski or snowboard in a symmetric manner relative to the longitudinal axis A. The security edges 30', 30" can also be applied in an asymmetric manner, i.e. they can be applied on the sides of the ski or snowboard 10 such that they are not opposite to each other (FIG. 5). The indentations or protrusions 30', 30" advantageously have an elliptical form or are curved, as illustrated. The indentations and protrusions 30', 30" according to one preferred construction have a length of 5 cm and a depth of 0.1 to 0.2 cm. The number and arrangement of the indentations and protrusions 30', 30" on the two lateral sides of the ski or snowboard varies.

FIG. 5 shows an example of a ski with an asymmetric arrangement of protrusions 30" wherein, on one lateral side of the ski 10 there are three protrusions 30" and on the other lateral side of the ski 10 there is only one protrusion 30". FIG. 6 shows an example of a ski 10 with a symmetric arrangement of five indentations 30' on each ski side. FIG. 7 shows an example of a snowboard 10 with a symmetric arrangement of the protrusions 30" on each snowboard side, but wherein the front, middle and rear protrusions 3" differ in length and width. The specialist with knowledge of the present invention has further possibilities for the design of such edges and security edges of skis or snowboards at his or her disposal.

The security edges offer a permanent grip on surfaces such as snow, ice, artificial snow, etc. They especially offer grip in difficult skiing or snowboarding situations such as curves, braking, etc. The security edges offer a secure grip due to the provision of indentations and protrusions 30' and 30", even if the edges are not ground sharply, which is not the case with skis and snowboards with normal edges 3 defining a planar lateral side surface of the ski or snowboard.

A first manufacturing method for a ski or snowboard 10 with security edges 30', 30" according to the invention uses a ski or snowboard 10 with uniform edge thickness (i.e., the ski or snowboard of the prior art shown in FIG. 1), whereupon the edge thickness is locally modified to form indentations and/or protrusions 30', 30". This kind of design of indentations or protrusions is preferably realized by means of common milling machines such as laser, etc.

In a further manufacturing method for a ski or snowboard 10 with security edges 30', 30" according to the invention, edges with regions of uniform width (i.e., edges 30) and with regions of variable width in the form of indentations or protrusions 30', 30" are manufactured and attached between covering and bottom surface 4, 5. For this method again machines usual to the ski and snowboard industry can be used.

The specialist with knowledge of the present invention has the freedom to vary these two named manufacturing methods and may combine them.

The maintenance of these security edges is carried out with usual grinding machines, which are applied to the edges with slight pressure. Advantageously these grinding machines comprise movable grinding heads for grinding the indentations or protrusions.

What is claimed is:

1. A method for manufacturing a ski or snowboard, comprising the steps of:

providing a ski or snowboard having a top surface, a bottom surface, and two lateral sides extending between said top and bottom surfaces, said lateral sides having a generally uniform thickness and defining edges of said ski or snowboard, said ski or snowboard defining a longitudinal axis; and, locally converting, by grinding, each of said edges into a security edge that integrally extends along at least a portion of the length of said ski or snowboard between said top and bottom surfaces thereof, said security edges having a width that is variable over a length thereof so as to define generally planar portions and non-planar portions, said non-planar portions for each security edge including at least two indented portions that extend inwardly toward said longitudinal axis or at least two protruding portions that extend outwardly away from said longitudinal axis, wherein each of said non-planar portions is arranged next to one of said planar portions and at least one of said non-planar portions is disposed at a front half of the ski or snowboard while another of said non-planar portions is disposed at a rear half of the ski or snowboard.

2. A ski or snowboard defining a longitudinal axis and comprising a running surface, two lateral sides and a security edge secured to each of said two lateral sides of the ski or snowboard, each security edge comprising a lower surface essentially level with the running surface and a side surface, the lower surface and the side surface being at an angle to one another and together defining a brink for gripping on surfaces comprising ice or snow, each security edge having a width that is variable over a length thereof so as to define generally planar portions and non-planar portions, said non-planar portions for each security edge including at least two indented portions that extend inwardly relative to said planar portions or at least two protruding portions that extend outwardly away from said planar portions, wherein at least one of said non-planar portions is disposed at a front half of the ski or snowboard and at least one of said non-planar portions is disposed at a rear half of the ski or snowboard, and wherein the lower surface is free of fasteners for securing the security edge to the ski or snowboard.

3. The ski or snowboard of claim 2, wherein said angle between the lower surface and the side surface is essentially 90° in both, the planar portions and the non-planar portions.

4. The ski or snowboard according to claim 2, wherein in each of the non-planar portions the side surface is curved.

5. The ski or snowboard according to claim 2, wherein said security edges are continuous and uninterrupted.

6. The ski or snowboard according to claim 2, wherein the non-planar portions are arranged symmetrically on said first and second lateral sides of the ski or snowboard relative to said longitudinal axis.

7. The ski or snowboard according to claim 2, wherein the non-planar portions are arranged asymmetrically on said first and second lateral sides of the ski or snowboard relative to said longitudinal axis.

8. The ski or snowboard according to claim 2, wherein on at least one of said first and second lateral sides, a first one of said at least two indented portions has a different length dimension than a second one of said at least two indented portions, or a first one of said at least two protruding portions has a different length dimension than a second one of said at least two protruding portions.

9. The ski or snowboard according to claim 2, wherein the security edges are integrally secured to the lateral sides.

* * * * *